US007075221B2

(12) United States Patent
Saitou et al.

(10) Patent No.: US 7,075,221 B2
(45) **Date of Patent: *Jul. 11, 2006**

(54) PROJECTION TUBE HAVING DIFFERENT NECK DIAMETERS

(75) Inventors: Kouichi Saitou, Chonan (JP); Kazumasa Hirai, Mobara (JP); Tetsuo Asano, Mobara (JP); Kotaro Aoki, Mobara (JP); Yasuo Tanaka, Ichihara (JP)

(73) Assignees: Hitachi, Ltd., Chiba-ken (JP); Hitachi Electronic Devices, Ltd. Co., Chiba-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/636,795

(22) Filed: Aug. 7, 2003

(65) Prior Publication Data

US 2004/0027043 A1 Feb. 12, 2004

Related U.S. Application Data

(63) Continuation of application No. 09/909,195, filed on Jul. 19, 2001.

(30) Foreign Application Priority Data

May 29, 2001 (JP) ..... 2001-159789

(51) Int. Cl.
*H01J 29/86* (2006.01)
*H01J 29/70* (2006.01)

(52) U.S. Cl. ..... 313/477 R; 313/426

(58) Field of Classification Search ..... 313/477 R, 313/414, 418, 421, 441, 442, 426, 450, 440, 313/478, 477, 460

See application file for complete search history.

(56) References Cited

U.S. PATENT DOCUMENTS

| | | | | |
|---|---|---|---|---|
| 3,840,773 | A | 10/1974 | Hart | |
| 4,143,298 | A * | 3/1979 | Bing et al. | 313/450 |
| 4,485,329 | A * | 11/1984 | Donofrio et al. | 313/478 |
| 5,909,079 | A | 6/1999 | Uchida et al. | |
| 6,031,326 | A * | 2/2000 | Suzuki et al. | 313/414 |
| 6,133,685 | A * | 10/2000 | Konda et al. | 313/456 |
| 6,404,119 | B1 | 6/2002 | Hidaka et al. | |
| 6,717,347 | B1 * | 4/2004 | Kubosaka et al. | 313/477 R |
| 6,750,602 | B1 * | 6/2004 | Hirota et al. | 313/477 R |
| 6,847,159 | B1 * | 1/2005 | Suzuki et al. | 313/477 R |
| 2001/0024922 | A1 * | 9/2001 | Kudoh et al. | 445/34 |
| 2004/0041512 | A1 * | 3/2004 | Kubosaka et al. | 313/477 R |

FOREIGN PATENT DOCUMENTS

JP 57025656 * 10/1982

OTHER PUBLICATIONS

U.S. Appl. No. 09/909,195.*

* cited by examiner

*Primary Examiner*—Joseph Williams
*Assistant Examiner*—Peter Macchiarolo
(74) *Attorney, Agent, or Firm*—Milbank, Tweed, Hadley & McCloy LLP

(57) ABSTRACT

The present invention aims at maintaining the high focusing performance at a low deflection power in a single-beam projection tube which is used as a projection type TV receiver or a projector and is operated at a high voltage and with a high current. The neck outer diameter of a portion on which a deflection yoke is mounted is made smaller than the neck outer diameter of a portion which accommodates an electron gun. The maximum anode voltage of the projection tube is set to equal to or more than 25 kV and the maximum beam current is set to equal to or more than 4 mA

6 Claims, 5 Drawing Sheets

PROJECTION TUBE HAVING DIFFERENT NECK DIAMETERS

This application is a continuation of application Ser. No. 09/909,195, filed Jul. 19, 2001, which claims priority to Japanese Patent Application No. 2001-159789 filed May 29, 2001.

BACKGROUND OF THE INVENTION

1. Field of the Invention

The present invention relates to a projection tube which is used in a projection type TV receiver, a video projector or the like.

2. Description of the Related Art

An image of a cathode ray tube can be obtained by scanning an electron beam emitted from an electron gun by means of a deflection yoke. The deflection yoke is mounted in the vicinity of a joint portion between a neck and a funnel. The deflection sensitivity is enhanced as the neck outer diameter becomes smaller. However, when the neck outer diameter is made small to enhance the deflection sensitivity, the electron gun which is accommodated in the neck portion must be miniaturized correspondingly. When the electron gun is miniaturized, the diameter of an electron lens becomes small and hence, the focusing is degraded. That is, the deflection sensitivity and the focusing performance are in an opposed relationship.

A method which can solve such a problem is, for example, proposed in U.S. Pat. No. 3,163,794. In this patent, with respect to a cathode ray tube, there is disclosed a technique which enhances the deflection sensitivity by making the outer diameter of a portion of a neck on which a deflection yoke is mounted smaller than the outer diameter of a portion of the neck in which an electron gun is accommodated. The maximum operating voltage of the cathode ray tube described in this patent is set to 16 kV.

On the other hand, with respect to a color cathode ray tube, in Japanese Laid-open Patent Publication 185660/1999, there is disclosed a technique which enhances the deflection sensitivity by making the outer diameter of a portion of a neck on which a deflection yoke is mounted smaller than of a portion of the neck in which an electron gun is accommodated.

SUMMARY OF THE INVENTION

However, the cathode ray tube disclosed in the above-mentioned U.S. Pat. No. 3,163,794 has not been commercialized yet. This is because that the maximum voltage is low so that an advantage obtained by the reduction of the deflection power is small. Further, since it is necessary to ensure a fixed dimension as the distance of the deflection yoke in the tube axis direction, when the outer diameter of a neck is set in two stages in an actual cathode ray tube, the position of an electron gun is usually made remoter from a phosphor screen due to mechanical restrictions. Accordingly, the total length of the cathode ray tube is elongated and hence, it gives rise to disadvantages such as the deterioration of the focusing performance as side effects.

Further, the cathode ray tube which is disclosed in the above-mentioned Japanese Laid-open Patent Publication 185660/1999 has also not been commercialized yet. The reason for such a circumstance is considered as follows. That is, although three electron beams which are arranged in an inline array are generated in the color cathode ray tube, since the electron beams at both sides approach an inner wall of a neck tube at a narrowed neck portion, there is a possibility that the electron beams impinge on the inner wall of the neck tube. Accordingly, it is difficult to take a large shrinkage rate of the neck diameter and hence, the deflection sensitivity enhancing effect becomes extremely small.

A typical object of the present invention is to provide a single electron-beam type projection tube operable at a high voltage which can reduce the deflection power thus enhancing the focusing performance.

The typical constitution of the present invention lies in that in a projection tube (PRT) which is operable at a high voltage of equal to or more than 25 kV, with a single electron beam and with a large current, the outer diameter of a neck at a portion on which a deflection yoke is mounted is made smaller than the outer diameter of the neck at a portion which accommodates an electron gun.

Due to such a constitution, the reduction of the deflection power and the enhancement of the focusing performance can be achieved.

In the PRT, since (1) the cathode ray tube is operated at a high voltage, (2) scanning lines which are two to three times large in number compared to a usual TV set are used in many cases, (3) three PRTs are used in a projection type TV receiver and the like so that the advantage of reduction of the deflection power is remarkably large compared to the usual cathode ray tube.

Further, in the PRT, the Improvement of the spherical aberration which occurs when the diameter of an electron lens is enlarged is more important than the improvement of the deterioration of focusing which occurs by the expansion of electron beams derived from the repulsion of the electron beams. That is, in the PRT, the influence which is generated by enlarging the diameter of the lens of the electron gun is more important than the influence which is generated when the electron gun becomes remote from a phosphor screen by differing the neck diameter.

Accordingly, the advantages of the present invention which adopts the constitution of the PRT as the constitutional features are extremely large.

With respect to other constitutions of the present invention, the neck outer diameter at the portion on which the deflection yoke is mounted is set to a value equal to or less than 29.1 mm, the outer diameter of neck at the portion in which the electron gun is accommodated is set to a value more than 29.1 mm, and the diameter of a pin circle arrangement at a stem portion which supplies a voltage to the electron gun is set to a value equal to the case of the neck outer diameter of 29.1 mm.

Due to such a constitution, a deflection circuit system can use a standard circuit for a neck of 29.1 mm and the focusing performance can be enhanced.

DESCRIPTION OF THE PREFERRED EMBODIMENTS

An embodiment of a projection tube having different neck diameters according to the present invention is explained hereinafter in conjunction with attached drawings.

Figure 1:
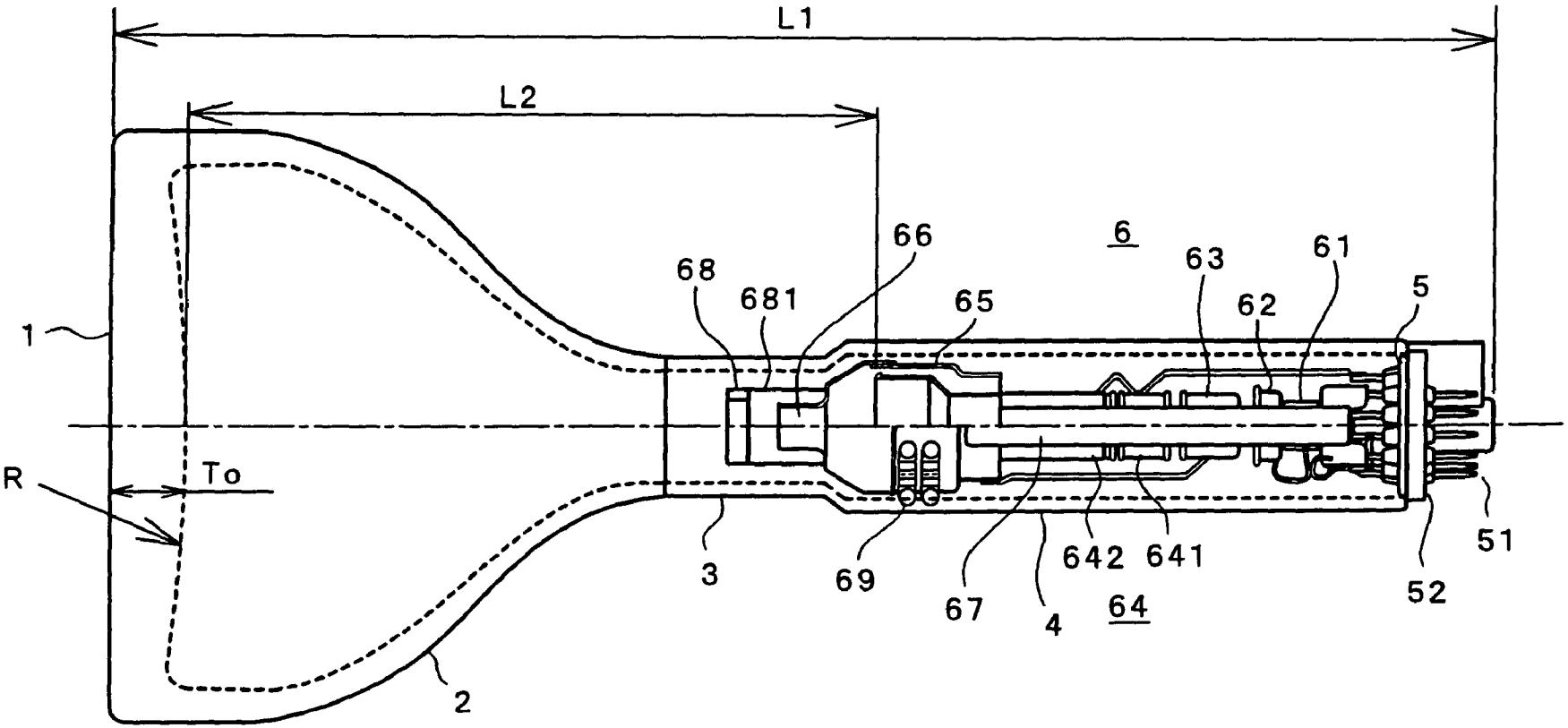
FIG. 1 is a schematic cross-sectional view of a cathode ray tube for a projection type TV receiver (PRT) of the present invention.

FIG. 1 is a schematic cross-sectional view of a cathode ray tube for a projection type TV receiver (PRT) of the present invention. A monochromatic image is formed in the PRT. Only one electron beam is used. A panel 1 has a flat outer surface and an inner surface which is bulged toward an electron gun side. With such a provision, a convex lens is formed. In this embodiment, the inner surface of the panel 1 is formed in a spherical face having a radius R of curvature of 350 mm. To reduce the aberration, the inner surface may be formed in a non-spherical face. The thickness To of the panel 1 at the center thereof is 14.1 mm. The profile size of the panel 1 in the diagonal direction is set to 7 inches and the effective diagonal diameter which allows the formation of image is set to 5.5 inches. The total length L1 of the PRT is set to 276 mm. A funnel 2 connects a neck portion 3 and the panel 1.

The outer diameter of the neck portion 3 is set to 29.1 mm. The outer diameter of a neck portion 4 which accommodates the electron gun is set larger than the outer diameter of the neck portion 3 and is set to 36.5 mm. Here, 29.1 mm and 36.5 mm which indicate the neck outer diameters mean substantial numerical values which are set in consideration of errors in manufacturing necks. A deflection yoke which deflects an electron beam is mounted on the neck portion 3 which has the small diameter. Due to such a constitution, the deflection power can be suppressed as small as possible. In this case, the deflection power can be reduced by approximately 25% compared with a case in which the neck outer diameter is set to 36.5 mm.

Since an electron gun 6 is accommodated in the neck portion 4 which has the large diameter, the diameter of an electron lens can be made large. A first grid 61 of the electron gun 6 has a cup-like shape and a cathode which emits the electron beam is accommodated in the first grid 61. An accelerating electrode 62 forms a prefocus lens together with the first grid electrode 61. An anode voltage of 30 kV which is a voltage applied to a second anode electrode 65 which constitutes a final electrode is also applied to a first anode 63. In general, the anode voltage applied to the PRT is equal to or more than 25 kV.

By making the neck outer diameters different, the electron gun 6 is positioned remote from a phosphor surface due to mechanical restrictions. When the electron gun 6 is positioned remote from the phosphor screen, the focusing is deteriorated. However, in the PRT, by rising the voltage to a high voltage, the PRT can easily cope with the problem concerned with the deterioration of focusing. The PRT can be operated at the maximum voltage of equal to or more than 30 kV.

A focus electrode 64 is divided into a focus electrode 641 and a focus electrode 642, wherein a focus voltage of approximately 8 kV is applied to both focus electrodes 641, 642. The distance L2 between a distal end of the focus electrode 642 and the inner surface of the panel 1 is set to 139.7 mm. The focus electrode 642 enlarges the diameter thereof at the phosphor screen side thereof and forms a large diameter main lens together with the second anode 65. This main lens can be made larger corresponding to the increase of the neck outer diameter.

Since the PRT requires a high brightness, a beam current (a cathode current) becomes equal to or more than 4 mA. To ensure the high focusing performance even with such a large current, it is extremely important that the diameter of the main lens can be increased. In the PRT, since the voltage on the phosphor screen is high, the expansion of the beam derived from the repulsion of space charge particularly at the time of supplying a large current becomes relatively small and the size of the electron beam spot on the phosphor screen at the time of supplying a large current is substantially determined by the expansion of the beam due to the spherical aberration of the electron gun.

A shield cup 66 integrally forms a main lens together with the second anode 65. The diameter of the phosphor screen side of the shield cup 66 is gradually made small. Corresponding to the constitution that the neck outer diameter becomes small in the vicinity of the distal end of the electron gun, the diameter of the electron gun in the vicinity of the distal end thereof is also made small thus preventing the electron gun from being positioned far remote from the phosphor screen.

Respective electrodes are fixedly secured by means of a bead glass 67. The phosphor screen side of the shield cup 66 has the outer diameter thereof made considerably smaller than that of the second anode 65. This provision is provided to prevent the deterioration of the withstand voltage which is caused by the adhesion of getter for enhancing the degree of vacuum in the inside of the PRT to the electrode. A ring-shaped getter 68 is connected to the shield cup 66 by means of a getter support 681.

A bulb spacer contact 69 plays a role of assuring a proper distance between an inner wall of the neck portion and the electron gun. Although the bulb spacer contact 69 is provided at a position which corresponds to the neck outer diameter of 36.5 mm in FIG. 1, the bulb spacer contact 69 may be provided at a position which corresponds to the neck outer diameter of 29.1 mm.

Figure 2:
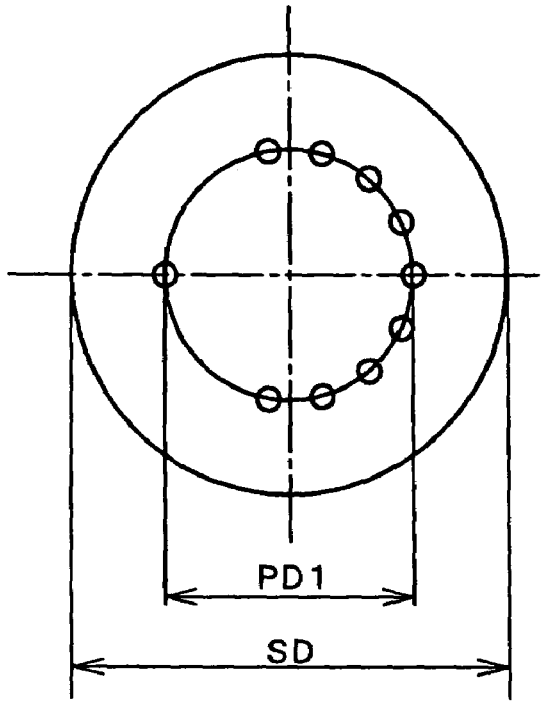
FIG. 2 is a plan view showing a stem portion of the PRT of the present invention.

The stem 5 is provided with pins 51 for supplying voltages to respective electrodes of the electron gun. A base 52 protects this stem 5 and the pins 51. FIG. 2 is a plan view of the stem portion according to this embodiment. The stem outer diameter SD is set to 28.3 mm and corresponds to the neck outer diameter 36.5 mm. The feature of this embodiment lies in that although the stem outer diameter corresponds to the neck outer diameter 36.5 mm, the pin circle diameter PD1 is set to 15.12 mm which is the diameter corresponding to the neck outer diameter of 29.1 mm. Here, 15.12 mm is a substantial value which is set by taking also the manufacturing error into consideration.

Figure 3:
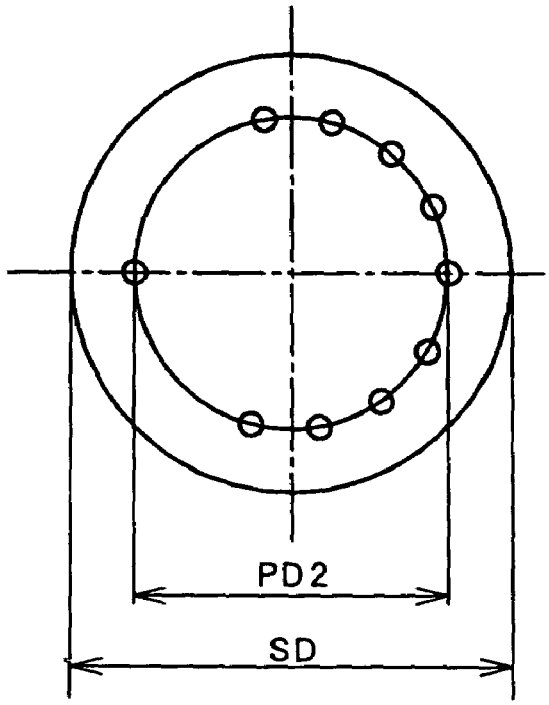
FIG. 3 is a plan view showing a stem portion in case of a usual 36.5 mm neck.

For a comparison purpose, a plan view of a usual stem portion when the neck outer diameter is set to 36.5 mm is shown in FIG. 3. The stem outer diameter SD is set to 28.3 mm and the pin circle diameter PD2 is set to 20.32 mm. It is a usual design to increase the pin circle corresponding to the increase of the neck outer diameter. It is because that the larger becomes the pin circle, the distance between respective pins becomes larger and hence, it is advantageous for the withstand voltage.

However, in this embodiment, the reason that while the neck outer diameter is set to 36.5 mm, the diameter of the pin circle is set to a diameter equal to the diameter of the pin circle when the neck outer diameter is set to 29.1 mm is as follows. That is, a portion of a deflection circuit is connected to the pins 51. Since a deflection yoke which corresponds to the neck outer diameter of 29.1 mm is used, by setting the diameter of the pin circle to a value which is equal to the diameter of the pin circle when the neck outer diameter is set to 29.1 mm, a circuit board which is equal to a circuit board when the neck outer diameter is 29.1 mm can be used. Further, as the connector, a connector for the neck outer diameter of 29.1 mm which has high generality can be used.

Figure 4:
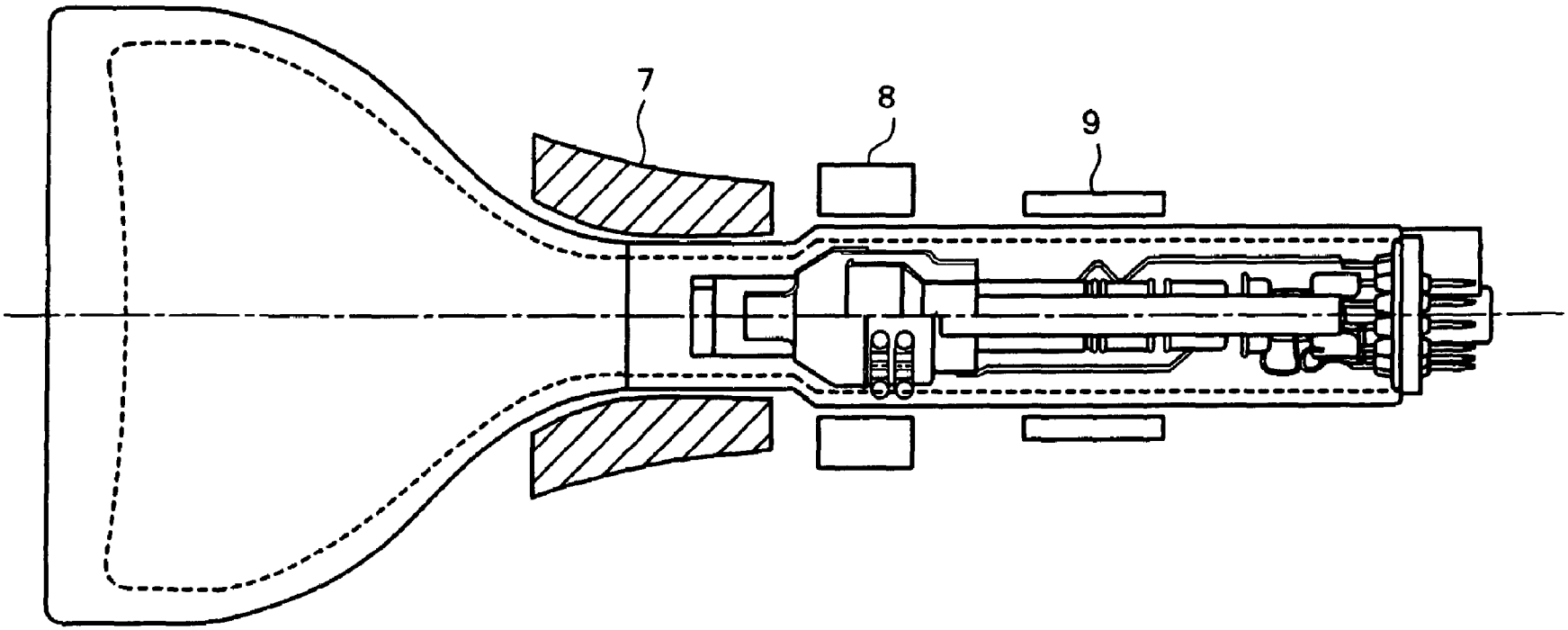
FIG. 4 is a schematic view showing a constitution in which a deflection yoke, a convergence yoke and a velocity modulation coil are mounted on the PRT of the present invention.

FIG. 4 is a schematic view showing a constitution in which a deflection yoke 7, a convergence yoke 8 and a velocity modulation coil 9 are mounted on the PRT of the present invention. The deflection yoke 7 is mounted on the neck portion 3 having the small diameter. The convergence yoke 8 is mounted on the neck portion 4 having the large diameter. The reason that the convergence yoke 8 is mounted on the neck portion 4 having the large diameter lies in the prevention of the excessive elongation of the total length of the PRT.

By allowing the total length of the PRT to be elongated and mounting the convergence yoke 8 on the neck portion 3 having the small diameter, the sensitivity of the convergence yoke 8 can be enhanced. Further, the integration of the deflection yoke 7 and the convergence yoke 8 can be facilitated.

Figure 5:
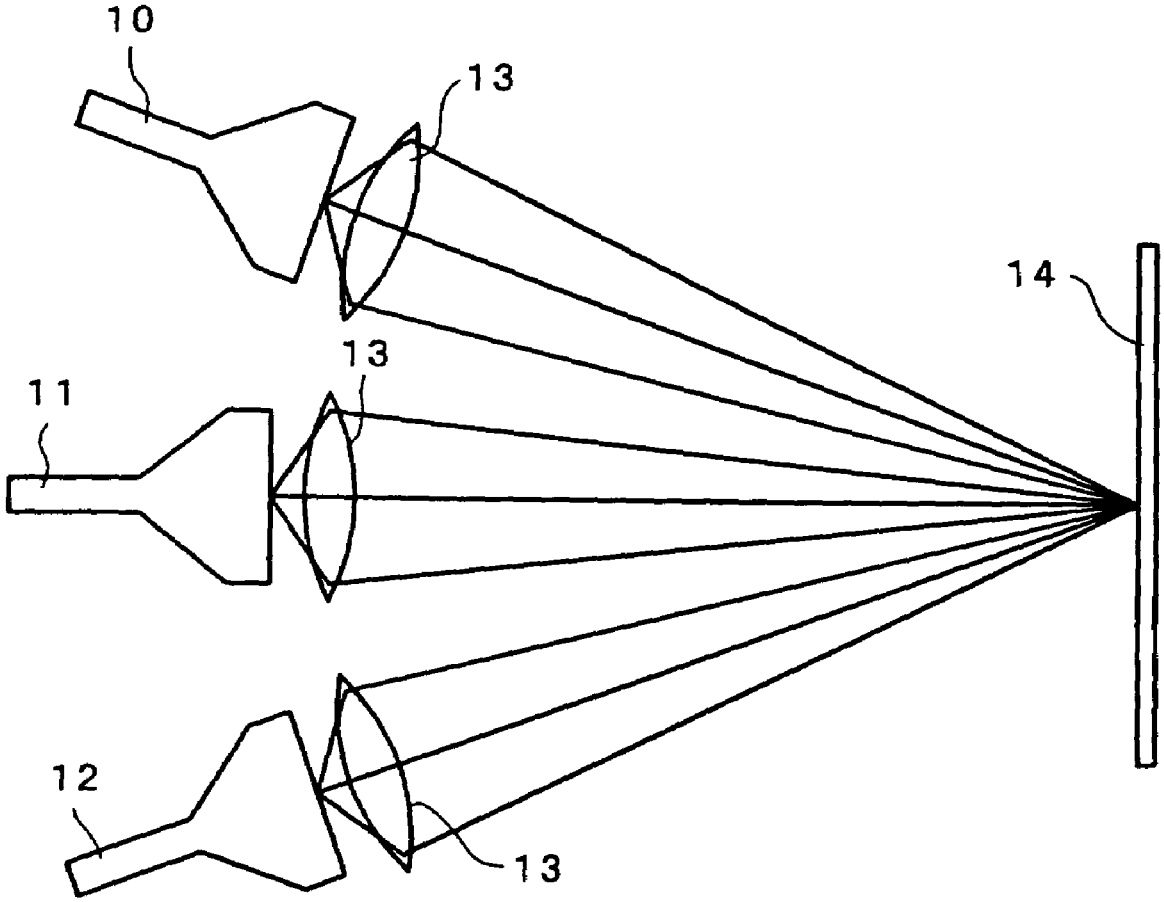
FIG. 5 is a conceptual view of a projection type TV receiver in a planar constitution.

As shown in FIG. 5, in a projection type TV receiver, images projected from three PRTs consisting of a red PRT 10, a green PRT 11 and a blue PRT 12 are converged on a screen 14 after passing through lenses 13 so as to form a projected image. Although the convergence is performed by inclining respective PRTs relative to each other, the fine adjustment is performed by the convergence yokes 8 mounted on the respective PRTs.

The velocity modulation coil 9 is served for enhancing the contrast of the image. Since the velocity modulation coil 9 is mounted on the portion having the neck outer diameter of 36.5 mm, the sensitivity becomes a problem. For enhancing the sensitivity of the velocity modulation coil 9, the focus electrode 64 is divided into the electrode 641 and the electrode 642 and a gap is formed between the electrode 641 and the electrode 642 so as to facilitate the application of the magnetic field of the velocity modulation coil 9 to the electron beams.

Figure 6:
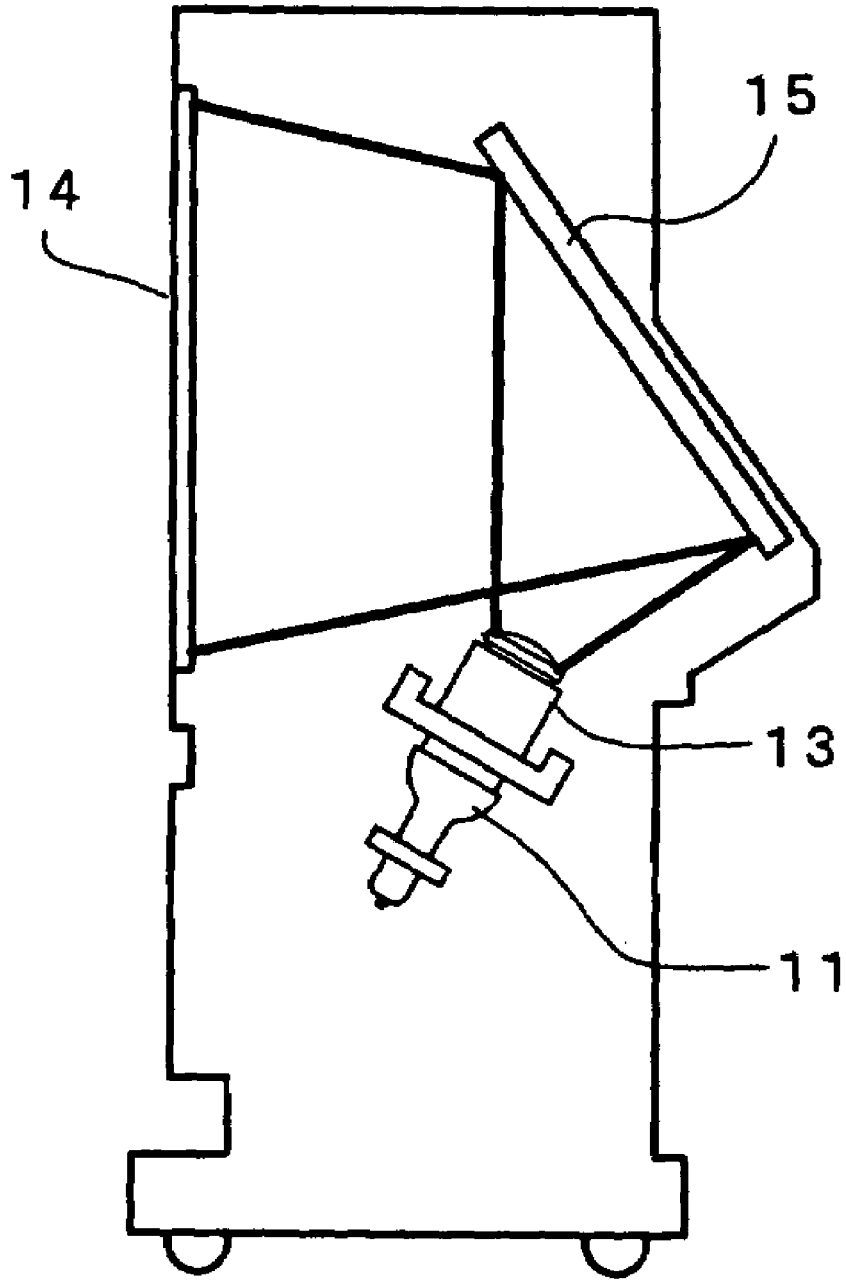
FIG. 6 is schematic longitudinal cross-sectional view of the projection typ TV receiver.

FIG. 6 is a schematic cross-sectional view of the projection type TV receiver. The image projected from the PRT 11 passes through the lens 13, is reflected on a mirror 15 and then is projected onto the screen 14. As shown in FIG. 6, the total length of the PRT does not directly influence the depth of the projection type TV receiver.

Further, since the projection type TV receiver uses three PRTs, with respect to the saving of the deflection power, the projection type TV receiver exhibits the deflection power saving effect which is three times higher than that of a usual TV set. Further, the projection type TV receiver usually has a large screen of a screen diagonal size of equal to or more than 40 inches. In such a large screen, scanning lines become apparent thus deteriorating the image quality when usual NTSC signals are used. To prevent this phenomenon, in the projection type TV receiver, the ADVANCED TV method which has a large number of scanning lines is adopted in many cases. In this case, the number of scanning lines becomes two to three times larger than that of the usual NTSC method so that the deflection power is increased. Accordingly, with the use of the PRT according to the present invention, an extremely large deflection power saving effect can be obtained in the projection type TV receiver.

The present invention is applicable not only to the projection type TV receiver but also to a general projector which uses three PRTs.

As has been described heretofore, according to the typical constitution of the present invention, the deflection power of the projection tube can be reduced and the focusing performance can be enhanced.

What is claimed is:

1. A projection tube comprising a panel having a phosphor screen on an inner surface thereof, a funnel, a neck portion, and a stem portion which seals the neck portion, wherein:

the neck portion includes a first neck portion which constitutes a portion connected to the funnel portion and has a first outer diameter of the neck portion, and a second neck portion which constitutes a portion which accommodates an electron gun having a focus electrode and an anode electrode and has a second outer diameter of the neck portion;

the first outer diameter of the neck portion is set smaller than the second outer diameter of the neck portion;

a deflection yoke which deflects the electron beam is mounted on the first neck portion having the first outer diameter;

a velocity modulation coil is mounted on the second neck portion having the second outer diameter;

the electron gun emits a single electron beam to the phosphor screen;

the focus electrode is divided into a first focus electrode and a second focus electrode having a gap therebetween, and a focus voltage is applied to both the first focus electrode and the second focus electrode;

the focus electrode and the anode electrode are disposed in the second neck portion; and a maximum operating voltage of the electron gun is set to equal to or more than 25 kV.

2. A projection tube according to claim 1, wherein the maximum operating voltage is set to or equal to more than 30 kV.

3. A projection tube according to claim 1, wherein a maximum cathode current is set to equal to or more than 4 mA.

4. A projection tube according to claim 1, wherein the first outer diameter of the neck portion is set to equal to or less then 29.1 mm.

5. A projection tube according to claim 1, wherein the second diameter of the neck portion is set to equal to or more the 36.5 mm.

6. A projection tube according to claim 1, wherein the first outer diameter of the neck portion is set to 29.1 mm and the second outer diameter of the neck portion is set to 36.5 mm.

* * * * *